US005941435A

United States Patent [19]

Munro, III

[11] Patent Number: 5,941,435

[45] Date of Patent: Aug. 24, 1999

[54] COLLAPSIBLE, QUICK-RELEASE SNOWBOARDING POLE WITH LEG MOUNTING SYSTEM

[75] Inventor: Alexander Finlay Munro, III, M.B., Calif.

[73] Assignee: Stephen James Smith, Richardson, Tex.

[21] Appl. No.: 08/621,234

[22] Filed: Mar. 25, 1996

[51] Int. Cl.[6] ..... A45F 5/00

[52] U.S. Cl. ..... 224/267; 224/222; 224/917; 280/814; 280/823

[58] Field of Search ..... 224/191, 200, 224/218–222, 267, 269, 242, 245, 247, 249, 917, 922; 280/819, 821, 823, 814; 602/5, 23, 27, 28

[56] References Cited

U.S. PATENT DOCUMENTS

| | | | |
|---|---|---|---|
| 1,761,497 | 6/1930 | Smith | 224/222 |
| 1,786,254 | 12/1930 | Meehan | 224/222 |
| 2,620,210 | 12/1952 | Wuster | 280/823 |
| 2,888,705 | 6/1959 | Bray | 224/222 |
| 3,064,644 | 11/1962 | Patterson | 602/23 |
| 3,712,652 | 1/1973 | Uilkema | 280/823 |
| 3,722,903 | 3/1973 | Jones | 280/11.37 F |
| 3,730,544 | 5/1973 | Hyman | 280/11.37 L |
| 3,859,991 | 1/1975 | Theodores | 602/28 |
| 4,508,467 | 4/1985 | Choffin | 403/104 |
| 4,681,246 | 7/1987 | Andersson | 224/222 |
| 4,821,934 | 4/1989 | Alessi et al. . | |
| 4,953,892 | 9/1990 | Adkins | 280/814 |
| 5,088,480 | 2/1992 | Wang | 602/27 |
| 5,139,283 | 8/1992 | Dow et al. | 280/819 |
| 5,261,581 | 11/1993 | Harden, Sr. | 224/219 |
| 5,289,961 | 3/1994 | Levitt et al. | 224/219 |
| 5,310,102 | 5/1994 | Hougham | 224/267 |
| 5,400,937 | 3/1995 | Rottenberg | 224/258 |
| 5,441,307 | 8/1995 | Quintana et al. | 280/823 |
| 5,443,287 | 8/1995 | Wells | 280/822 |
| 5,452,830 | 9/1995 | Hopkins et al. . | |

FOREIGN PATENT DOCUMENTS

| | | | |
|---|---|---|---|
| 72856 | 10/1945 | Norway | 224/222 |

*Primary Examiner*—Gregory M. Vidovich
*Attorney, Agent, or Firm*—Hitt, Chwang & Gaines, P.C.

[57] ABSTRACT

A single, telescoping, collapsible, quick-release snowboarding pole with leg mounting system includes a telescoping, collapsible pole and leg mounting assemblies, to secure the pole, in the collapsed position, to the lower leg of an individual, such as a snowboarder. This invention allows the user to quickly release the collapsed pole from the leg mounting assemblies and extend and lock the telescoping pole, to use as needed, usually to gain momentum while snowboarding or performing other outdoor sports. The pole comprises three sections of telescoping tubing, the lower pole section sliding into the middle pole section which then slides into the upper pole section, in the collapsed position. The pole is locked into its extended position by way of two snap-lock buttons positioned inside the middle and lower pole sections, respectively. The pole also comprises a palm-grip paddle handle attached to the top of the upper pole section and an inverted, snowboard-shaped basket, mounted perpendicularly, at an angle, to the lower pole section near the pole tip. The two mounting assemblies, attached to the user's ankle and upper calf just below the knee, respectively, comprise molded plastic mounting brackets which permit the quick attachment and release of the collapsed pole from the user's leg.

10 Claims, 6 Drawing Sheets

COLLAPSIBLE, QUICK-RELEASE SNOWBOARDING POLE WITH LEG MOUNTING SYSTEM

TECHNICAL FIELD

This invention relates to a leg mounted, collapsible, telescoping, quick-release pole with system for mounting such, in its collapsed position, on the lower leg of an individual, such as a snowboarder, and others engaging in outdoor sports or activities where such a pole is need.

BACKGROUND ART

In recent years, skiers have been sharing the slopes with those participating in a relatively new sport; snowboarding. Unlike a skier, a snowboarder has both feet strapped or clipped to a single board. Until now, snowboarders have not used poles because holding a pole inhibits a snowboarder's freedom and movement while riding down the slopes. As such, snowboarders are virtually non-ambulatory when on relatively level ground and while getting onto and off of chair lifts designed to accommodate skiers. Because of this, snowboarders have been forced to unbuckle or unclip one foot from the board to awkwardly push themselves along in these situations.

Unbuckling or unclipping one's foot can be a cumbersome task and cannot be done while moving. Additionally, as it is desirable to have both feet securely in place on the board when dismounting the chair lift at the top of a slope, traditionally, a snowboarder would have to either re-buckle or re-clip his free foot to the board while riding the lift or, with no stabilizing aid, he would have to get onto the lift with both feet secured to the board. Both of these situations present potential hazards to the snowboarder's safety.

While the popularity of snowboarding continues to grow, this inconvenience associated with snowboarding on slopes designed for skiers has been sufficient to deter some from attempting the sport and to add unnecessary exertion for those who do participate. Releasable bindings have been the industry focus for the solution to this problem. While one foreign company has developed a strap for attaching two traditional collapsible ski poles to the instep of a snowboarder's boot while back-country riding, snowboarders have yet to have a single, two-handled pole designed specifically for them with collapsible, quick-release capability for easy, immediate deployment in all mountain situations.

SUMMARY OF INVENTION

This invention relates to a three sectioned, telescoping, collapsible, quick-release pole, comprising a palm-grip, paddle-type handle at the top of the pole, three sections which collapse into one another when the pole is in the collapsed position, two collars to secure the three sections of the pole in its extended position, and an inverted snowboard-shaped basket mounted perpendicularly, at an angle, to the lower pole section near the tip of the pole. In its collapsed position, the pole mounts to the outside of the lower leg of the user, such as a snowboarder, by way of two molded plastic mounting brackets, each fastened to the user's leg by way of two straps worn around the user's leg, one just below the knee and one near the ankle or boot.

It is an object of the present invention to provide a quick and easy method whereby an individual, such as a snowboarder, can gain or maintain momentum on level stretches, when loading or unloading chair lifts, and when stuck in powder, without unbuckling any of his or her snowboard boot bindings. The user of this invention can simply disengage the pole from the mounting brackets on the straps on his or her lower leg, extend the pole by pulling it lengthwise and engaging the two snap-buttons on the pole, and move himself or herself along by using the pole with one or two hands. When the pole is no longer needed, the user can quickly and easily collapse it by pushing in on the two snap-buttons on the pole, collapsing it and re-securing the collapsed pole to the molded plastic mounting brackets strapped to his or her lower leg.

The pole portion of the invention is characterized by elongated upper, middle and lower tubular pole sections, which collapse and lock together in a telescoping fashion. Upper and lower collars provide barriers between the three pole sections when said pole is in the extended position by way of operative snap-buttons, which expand to lock said pole in its extended position. The upper ends of said middle and lower pole sections are flared outward, which prevents said sections from extending all the way through said upper and lower collars when said pole is extended. This technology is presumed to be common place in the telescoping tubing industry and not of unique nature to this invention.

In carrying out the embodiment of the invention, the mounting and quick-release of said extendible pole from the user's lower leg is achieved with two leg mounting assemblies, attached to the outside of the user's lower leg at the ankle and just below the knee by way of nylon or polypropylene webbing straps which wrap around the user's lower leg at the ankle and just below the knee. These straps are held in place by common plastic buckles and clips.

The inverted, snowboard-shaped basket is mounted perpendicularly to the length of said pole, at an angle, with edges of said basket turned down so as both turned down edges wrap around the outside of the user's leg and to deflect oncoming snow and debris when said pole is in its collapsed position secured to the user's leg. The upper longitudinal edge of the basket closest to the palm-grip handle runs perpendicular to the length of the pole and is used to secure the pole against the person's leg by way of the molded angled basket-securing bracket.

The angled basket-securing bracket is attached to the ankle strap at the upper vertical portion of said bracket by way of two vertical slots which accept webbing or fasteners. The purpose of said bracket is to mount and secure the basket and lower end of the collapsed pole to the user's leg. Said bracket is an obtusely angled molded plastic part comprising an upper and a lower insertion guide. Said bracket also comprises a longitudinally formed channel to guide the pole tip into a pole insertion channel. Said basket is secured to said bracket by inserting said pole tip down the insertion guide into the pole insertion channel of said bracket until the bottom of said basket is flush with the top of said bracket's base plate, and upper longitudinal engaging edge of said basket clips under the basket-securing lip of said bracket. The bottom end of the bracket contains a break-away release opening allowing the lower end of said pole to break free from said bracket.

To mount and secure the upper end of said collapsed pole, the flexible mounting bracket is fastened to the cam lever of a cam-type plastic buckle by way of any screw-type fastener secured through a mounting hole in the base of said flexible bracket. Said fastener extends through a cam lever to a nut in the crux of the underside of said cam lever, so as to allow the free movement of webbing through said cam and uninhibited operation of said buckle. A nylon or polypropylene webbing strap, which is woven through strap guides on said cam-type buckle, secures said cam-type buckle to user's lower leg, just below the knee. Said flexible mounting bracket allows the upper section of said collapsed pole to be quickly and easily clipped and unclipped to user's leg, while still permitting full knee and leg movement.

The paddle-type, palm-grip handle is longitudinally mounted to the upper end of the upper pole section so as to allow the user to grip said pole with one hand on said paddle and the other hand on said upper or middle pole sections to gain leverage to push against the snow in order to gain or maintain momentum on flat stretches of terrain or on a needed basis.

Although the herein invention pertains to an adjustable, sectional snowboarding pole, which is best suited to manufacturers, retailers and users, the essence of the concept has to do with attaching or mounting a collapsible, telescoping pole, or a single tube, to one's leg so as to permit full range of leg and body motion, with said pole or tube capable of being quickly released from the mounts or brackets on the user's leg. This invention also lends itself to practical application for other sporting and occupational uses including, but not limited to, mountain climbing, hiking, walking, window washing and painting.

BEST MODE FOR CARRYING OUT THE INVENTION

Figure 1:
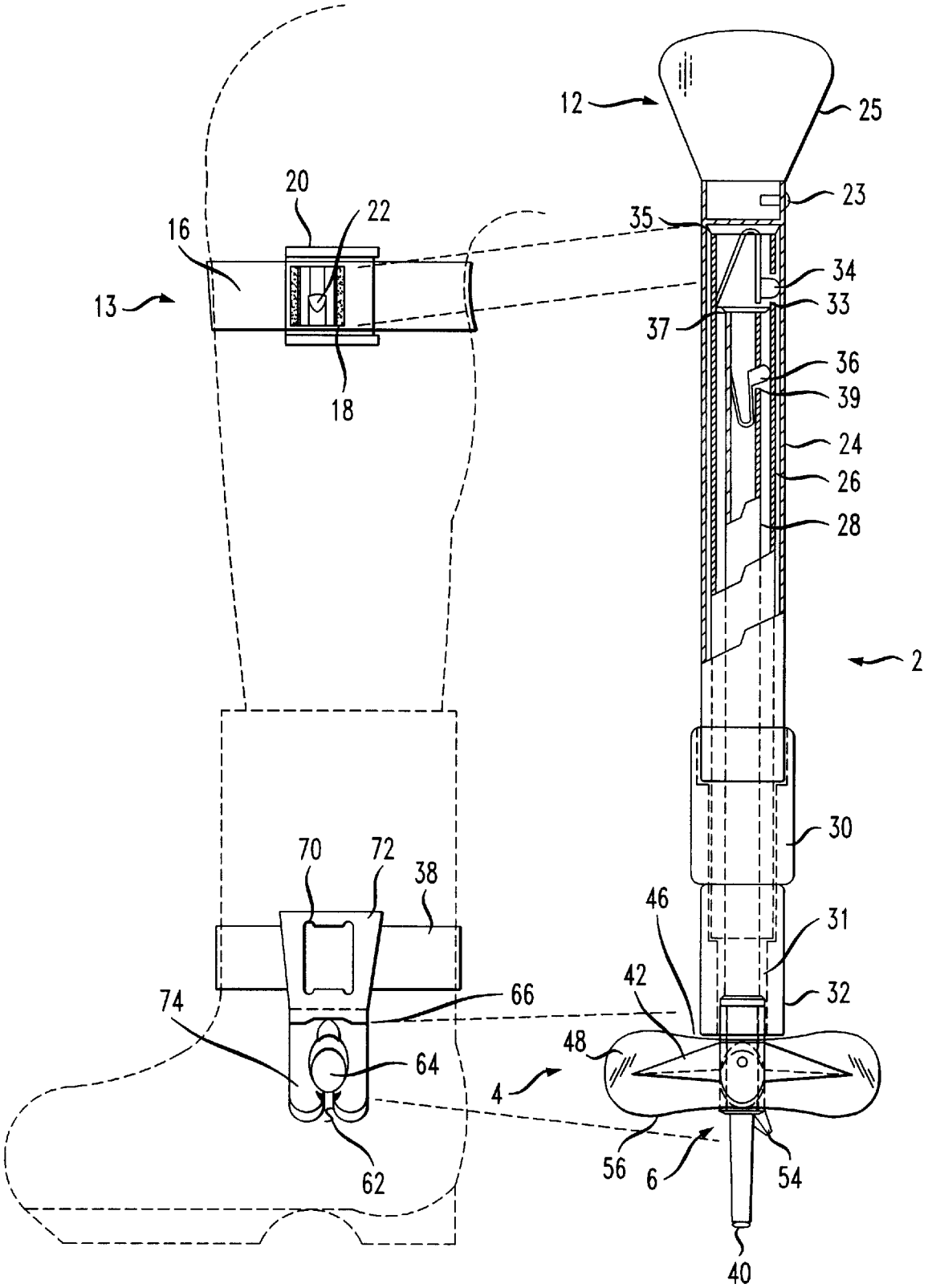
FIG. 1 depicts the relationship between the leg of a user, such as a snowboarder, with two mounting brackets for said pole in its collapsed position, strapped to the user's lower leg, one below the knee and one on the ankle or boot.

Reference is made to FIG. 1 which depicts the three sectioned, telescoping pole 2 in its collapsed position as it would be clipped and secured on the outside of the user's lower leg by way of the flexible bracket mounting system 13 and the quick-release, angled basket-securing bracket 8.

Said quick-release, angled basket-securing bracket 8 is woven, screwed, riveted or attached with Velcro (open loop fasteners) or slots, to the ankle strap 38, said ankle strap being worn around the user's ankle or boot. In said pole's 2 collapsed position, the angle-mounted, inverted, snowboard-shaped basket 4 is clipped or secured to the user's lower leg by way of the quick-release, angled basket-securing bracket 8.

Figure 2:
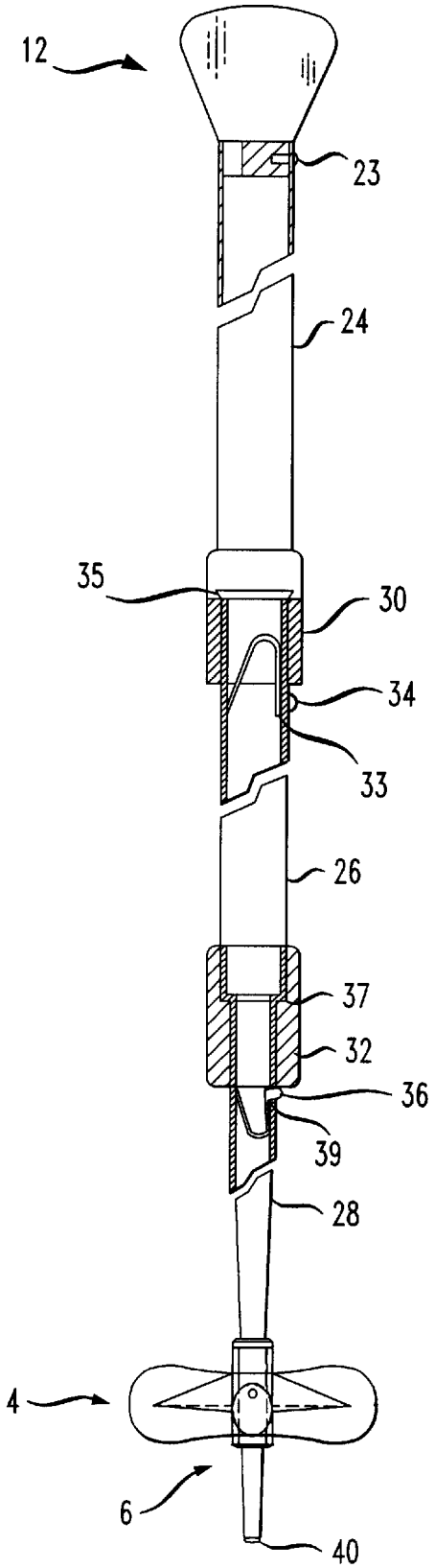
FIG. 2 is a side view of the collapsible pole in its extended position.

FIG. 2 also depicts the upper, middle and lower pole sections 24, 26 and 28, respectively, which are constructed of thin-walled aluminum or graphite. The upper collar 30 and lower collar 32 are constructed of aluminum or molded plastic. Said upper collar 30 has an upper inner diameter slightly larger than the diameter of the outside of said upper pole section 24 to form a pressure fit between said parts with glue, pins or other adhesive means. The inner diameter of the lower portion of upper collar 30 is bored to allow sufficient clearance between said upper collar 30 and said middle pole section 26, permitting said middle pole section 26 to slide freely in said upper collar 30. Said middle pole section's upper end 35 is flared or beaded outward so as to prevent said middle pole section 26 from sliding completely out of said upper collar 30.

Said lower collar 32 has an upper inner diameter slightly larger than the diameter of the outside of said middle pole section 26 to form a pressure fit between said parts with glue, pins or other adhesive means. The inner diameter of the lower portion of lower collar 32 is bored to allow sufficient clearance between said lower collar 32 and said lower pole section 28 permitting said lower pole section 28 to slide freely in said lower collar 32. Said lower pole section's upper end 37 is flared or beaded outward so as to prevent said lower pole section 28 from sliding completely out of said lower collar 32. The lower end of said lower pole section 28 is swaged to the pole tip 40 to reach diameter of pole tip 40 and to allow said pole tip's 40 effective use in snow.

A middle pole snap-button hole 33 and a lower pole snap-button 39 hole are drilled through one side of the tubing just below the bottom of the said upper and lower collars 30 and 32, in middle pole section 26 and said lower pole section 28, respectively, in the extended position. Industry standard snap-buttons 34 and 36 are placed in the upper portions of the inside of said middle pole section 26 and said lower pole section 28, respectively. Said snap-buttons 34 and 36 are rounded at the top to allow for the free collapse and extension of said lower pole section 28 into said middle pole section 26 and said middle pole section 26 into said upper pole section 24. Said snap-buttons 34 and 36 are located the exact same distance down from the top of the said middle pole section 26 and said lower pole section 28, respectively.

This positioning of said snap-buttons 34 and 36 permits said snap-buttons to expand outwardly against inner walls of said middle pole section 26 and said lower pole section 28 when said pole 2 is fully extended permitting the head of said buttons 34 and 36 to protrude out beyond the outer walls of said tubing by way of said middle pole section snap-button hole 33 and said lower pole section snap-button hole 39, against edge of said upper collar 30 and said lower collar 32, respectively. As deployed, said snap-buttons 34 and 36 prevent said upper, middle and lower pole sections 24, 26 and 28 from collapsing together when said pole 2 is in the extended position. When said pole 2 is in the extended position, said pole 2 is manually collapsed by pushing one's thumb or finger in on the heads of said snap-buttons 34 and 36 until the heads of said snap-buttons 34 and 36 are flush with said middle pole section 26 and said lower pole section 28, respectively, and then pushing the upper, middle and lower pole sections 24, 26 and 28 together.

Figure 3:
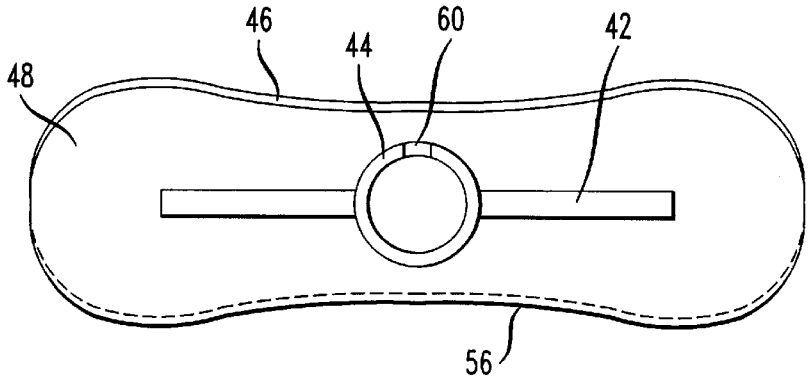
FIG. 3 is a top view of the angle-mounted, inverted, snowboard-shaped basket.
Figure 4:
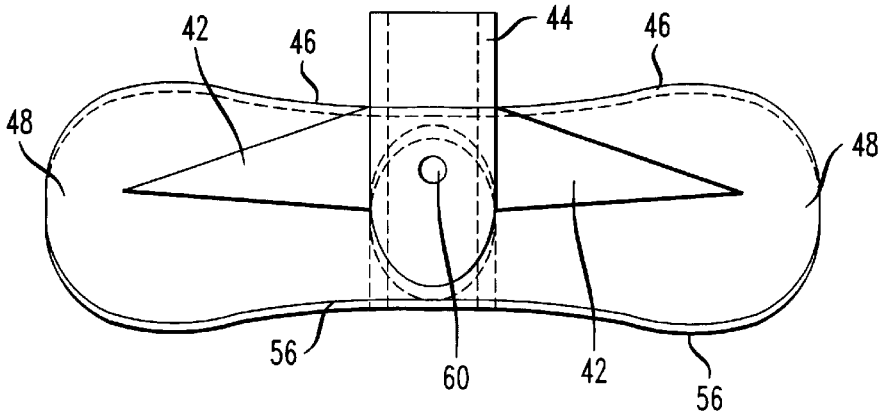
FIG. 4 is a front of the angle-mounted, inverted, snowboard-shaped basket.
Figure 5:
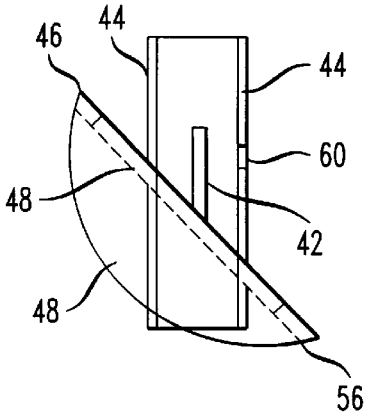
FIG. 5 is a side of the angle-mounted, inverted, snowboard-shaped basket.

FIGS. 3, 4 and 5 depict said angle-mounted, inverted, snowboard-shaped basket 4, constructed from a single molded piece of plastic, plastic composite or metal. Said basket 4 comprises support ribs 42, running lengthwise on the top side of said basket 4 from center column 44 out towards said basket's turned down ends 48. The purpose of said support ribs 42 is to maintain the structural integrity of said basket 4 when the user, with said pole 2 in its extended position, pushes said pole tip 40 into snow or against the ground. Said basket 4 also comprises a center support column 44, the purpose of which is to attach said basket 4 to the basket collar insert 6, which is press-fitted and pinned to said lower pole section 28 near said pole tip 40, as depicted in FIG. 1.

Figure 6:
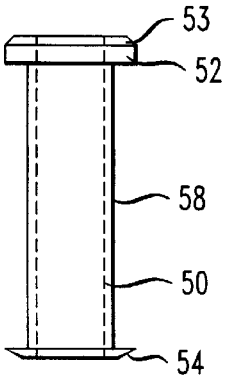
FIG. 6 is side view of the basket collar insert.

FIG. 6 depicts said basket collar insert 6, the purpose of which is to secure said basket 4 from sliding up said lower pole section 28 when said pole 2 is in the extended position. Said basket collar insert 6 comprises an upper ring 52 which is of larger diameter than said basket collar's external wall 58. The top 53 of the upper ring 52 is tapered inward from the outermost diameter of said upper ring 52 to the point where the top of said basket collar insert 6 meets said lower pole section 28 permitting said upper ring 52 and said support column 44 to slide into said lower collar 32 preventing snow and debris from entering the pole's internal cavity of the pole 31, as depicted in FIG. 1, when said pole 2 is in the collapsed position.

Said inverted, snowboard-shaped basket 4 also comprises down-turned ends 48, similar to those on an inverted snowboard, for the purpose of deflecting oncoming snow and debris when the collapsed pole 2 is mounted to the user's leg as indicated in FIG. 1. Said basket 4 has a lower edge 56 running the length of said basket 4, which, when said pole 2 is collapsed and mounted to the user's leg, is positioned away from the user's foot or ankle and is the longitudinal edge of said basket 4 which is closest to said pole tip 40. When said pole 2 is in its collapsed position and mounted to the user's leg, the upper engaging edge 46, which runs the length of said basket 4, is positioned next to the user's foot or ankle and is the longitudinal edge of said basket 4 which is farthest away from said pole tip 40. Said upper engaging edge 46 clips under the basket-securing lip 66 on said bracket 8 depicted in FIG. 9.

Figure 7:
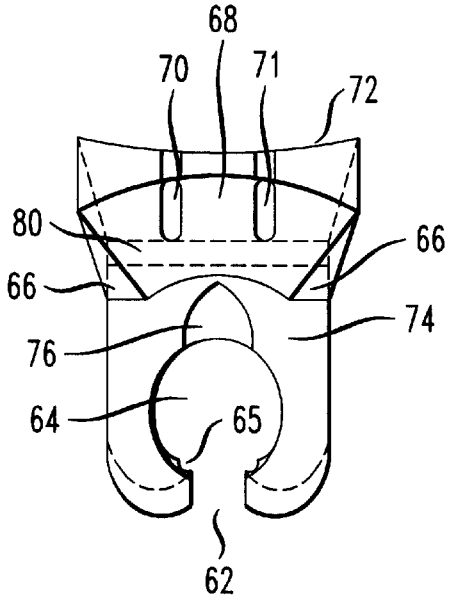
FIG. 7 is a top view of the quick-release, angled basket-securing bracket.
Figure 8:
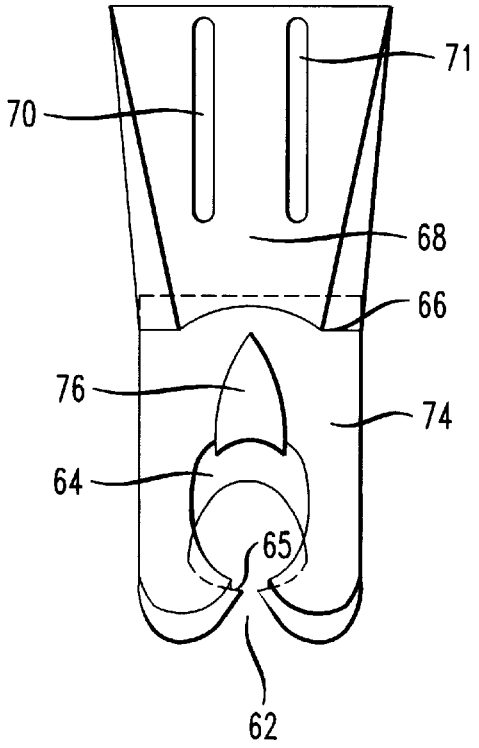
FIG. 8 is a front view of the quick-release, angled basket-securing bracket.
Figure 9:
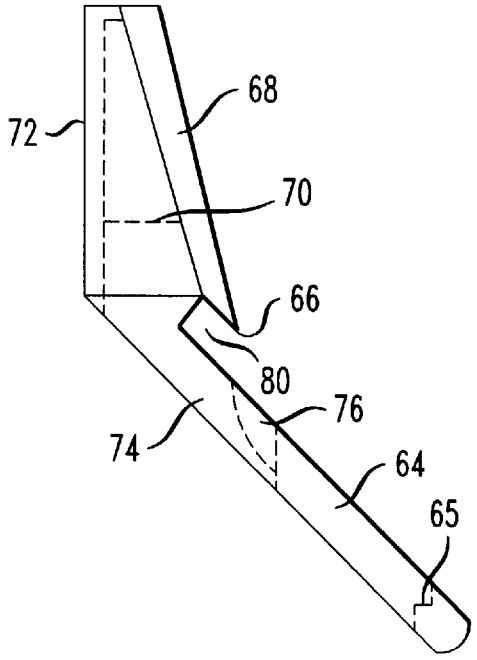
FIG. 9 is a side view of the quick-release, angled basket-securing bracket.

FIGS. 7, 8 and 9 depict the obtusely angled basket-securing bracket 8, the obtuse angle of which faces away from the user's ankle or boot when said bracket 8 is mounted or strapped to the user's leg. Said bracket 8 comprises two vertical mounting slots 70 and 71 on the back mounting wall 72 of said bracket 8 for operative 1 inch to 1½ inch nylon-type strapping comprising the ankle strap 38, as depicted in FIG. 1, or common fasteners, for the mounting of the said bracket 8 directly to the user's boot. Said bracket 8 contains said back mounting wall 72, which curves to mold with the user's ankle or boot for a comfortable and secure fit of said bracket 8 on the user's ankle or boot. As said bracket 8 is mounted or strapped to the user's ankle or boot, said bracket's upper insertion guide 68, on the upper outside portion of said bracket 8 curving away from the user's ankle or boot. Said upper insertion guide 68 is located above the lower insertion guide 76, said lower insertion guide being a scooped depression in the base plate 74. The purpose of both said upper and lower insertion guides 68 and 76 is to facilitate the insertion of said pole tip 40 into the pole insertion channel 64.

Figure 10:
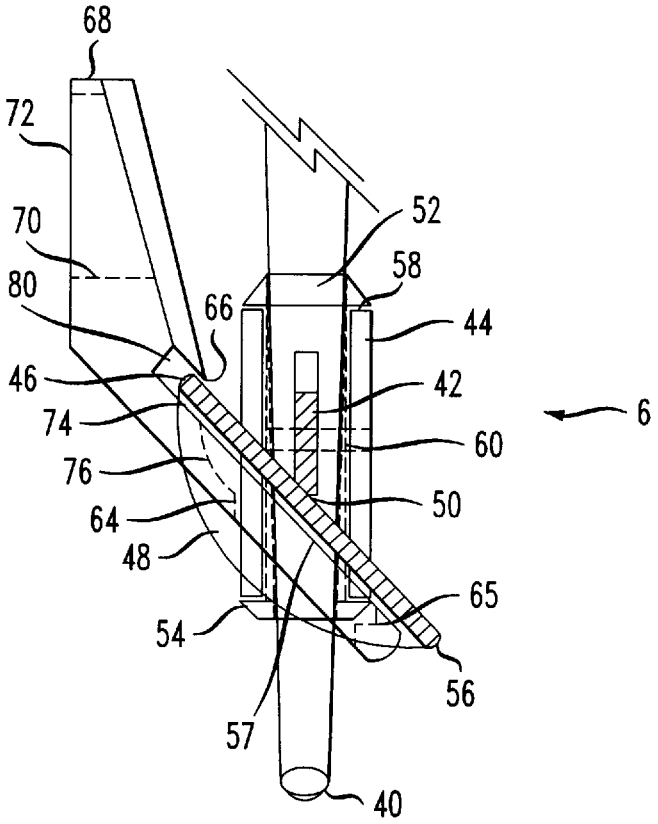
FIG. 10 is a side view of said basket and pole tip locked into the quick-release, angled, basket-securing bracket.

Said bracket's breakaway release opening 62 at the lower end of said base plate 74 allows said pole tip 40 of the collapsed pole 2, as depicted in FIG. 1, when mounted to user's leg, to release from said bracket in emergency situations where stress or friction pulls said pole tip 40 away from the user's leg. The critical feature of the said bracket 8 is said basket-securing lip 66, which shelters a narrow, channel 80. Said channel 80 runs perpendicular to the upper and lower insertion guides 68 and 76, along the full width of said bracket 8, sloping back and up behind the lowest portion of said upper insertion guide 68. The height of said channel 80, is slightly greater than the thickness of said basket 4, so as to permit said basket's upper engaging edge 46 to move, clip and lock in said channel 80, as depicted in FIG. 10. This allows the entire basket 4 and pole 2 to be quickly and easily secured in said bracket 8 and to be released from said bracket 9 when said pole 2 is in the collapsed position and said bracket 8 is mounted to the user's leg. Said basket-securing lip 66 serves to secure said basket's upper engaging edge 46 into said channel 80.

For said basket 4 to lock into said bracket 8, said pole tip 40 is inserted into said pole insertion channel 64, until the said basket's under surface 57 is flush with said bracket's base plate 74. The lower insert barb 54 of said basket collar insert 6, slides completely through the back of said bracket's pole insertion channel 64, by said lower insertion guide 76, and comes to a rest on the collar insert support 65 at the front of said pole insertion channel 64.

Figure 11:
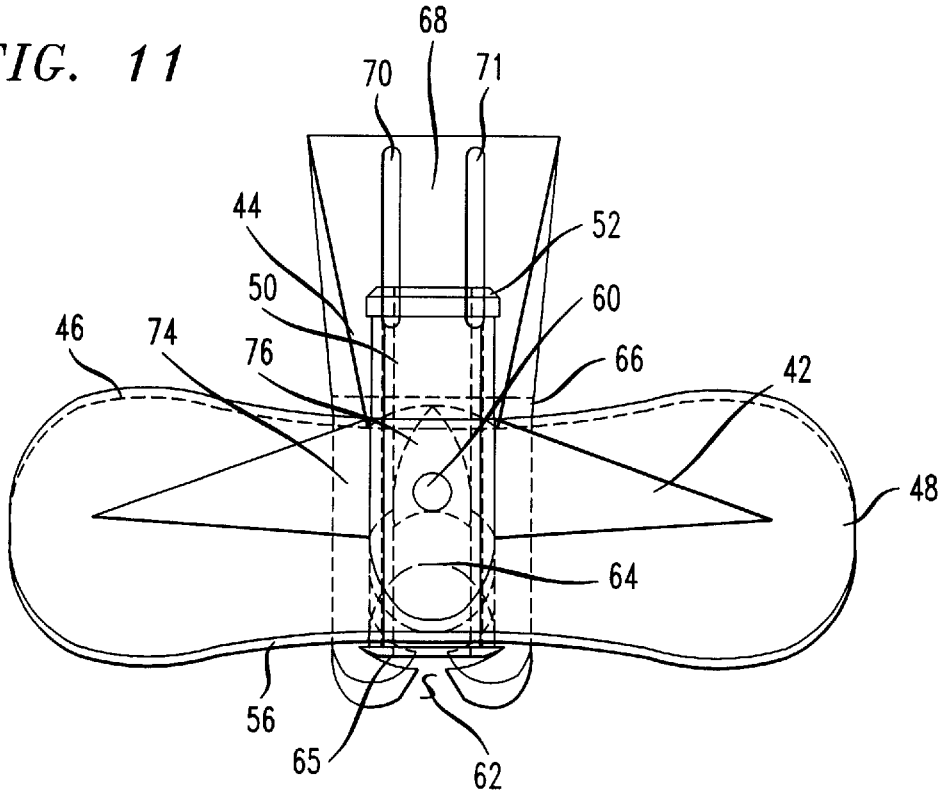
FIG. 11 is a front view of the angle-mounted, inverted, snowboard-shaped basket and the collar insert as mounted in the quick-release, angled basket-securing bracket.

FIGS. 10 and 11 illustrate how said basket (FIG. 4) and said bracket FIG. 8 fit together when said pole 2, in its collapsed position and is mounted on said bracket 8 on the user's leg. FIG. 10 illustrates the relationship between said basket 4 and said bracket 8. Said basket's underside 57 fits flush with top of said bracket's base plate 74, so as to allow said basket's upper engaging edge 46 to clip under said basket-securing lip 66 of said bracket 8. Said basket support column 44 and said lower basket collar insert barb 54, mounted to said lower pole section 28 near pole tip 40, are inserted through said insertion guide 64 and rests on said collar insert support 65 on said bracket 8. Said basket 4 can quick-release from said bracket 8 by pivoting said pole 2 and said basket 4 forward, away from said upper insertion guide 68, thus releasing said basket's upper engaging edge 46 from said basket-securing lip 66.

Said pole 2 and said basket 4 can also be released from said bracket 8 by pulling said pole tip 40 out through said release opening on said bracket 8. Said basket's down-turned ends 48 wrap around the user's foot when said pole 2 is mounted to said bracket 8 on user's ankle or boot as depicted in FIG. 1. Said pole 2 and said basket 4 are positioned with said bracket's release opening 62 and said basket's lower edge 56 away from the user's leg. This orientation facilitates the flow of snow and debris around the user's leg and ankle, while enabling said basket's upper engaging edge 66 to adjust into said bracket's channel 80 when collapsed pole is mounted to the user's leg.

Figure 12:
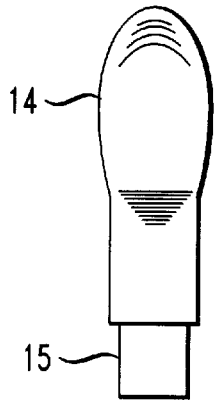
FIG. 12 is a side view of the paddle-type palm-grip handle.

FIG. 12 depicts a common paddle-type palm-grip 12, which comprises a base 15, which is inserted in top of upper pole section. The rounded handle 14, allows user to firmly grasp said grip 12 and place fingers over top of said grip 12 so as grasp said pole and grip with two hands and gain leverage on said grip.

Figure 13:
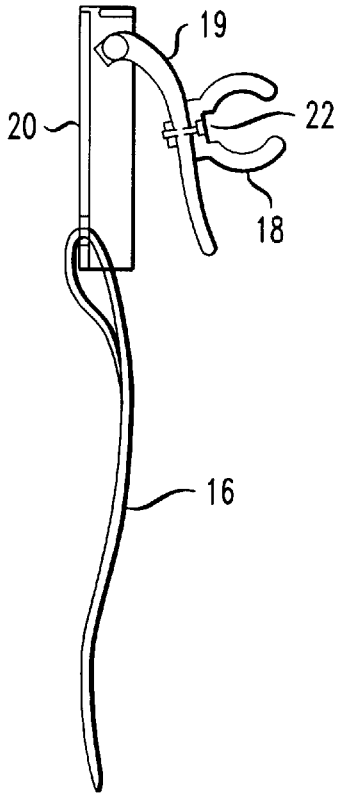
FIG. 13 is a side view of the flexible mounting bracket system.

As depicted in FIG. 13, the flexible mounting bracket 18 is screwed, riveted or otherwise attached to the cam arm 19 of a common cam-type buckle 20, or other securing system. Said cam buckle 20, with flexible mounting bracket 18 affixed thereto, secures the nylon-type shin strap 16, or other securing system to the user's lower leg just below the knee. In the collapsed position of said pole 2, the upper pole section 24 clips into said flexible mounting bracket 18.

I claim:

1. A telescoping snowboard pole having an upper end and a lower end and comprising:

first and second extensibly connected pole sections;

a handle attached to said upper end;

an oblong basket attached proximate, and at an angle with respect to, said lower end; and ankle and shin brackets that are securable to a user's leg and that releasably engage said telescoping snowboard pole.

2. The telescoping snowboard pole of claim 1 wherein said oblong basket has a substantially planar surface and at least one concave peripheral edge.

3. The telescoping snowboard pole of claim 1 wherein said ankle and shin brackets are coupled to corresponding ankle and shin straps.

4. The telescoping snowboard pole of claim 1 further comprising a snap button, coupled to said first pole section, that maintains said first and second pole sections in an extended position.

5. The telescoping snowboard pole of claim 1 wherein said ankle bracket comprises a channel that engages an upper edge of said basket.

6. A telescoping snowboard pole having an upper end and a lower end and comprising:

first and second extensibly connected pole sections;

a rounded paddle handle attached to said upper end;

a basket attached to said lower end; and ankle and shin brackets that are securable to a user's leg and that releasably engage said telescoping snowboard pole.

7. The telescoping snowboard pole of claim 6 wherein said basket is oblong.

8. The telescoping snowboard pole of claim 6 wherein said basket is attached at an angle to said lower end.

9. The telescoping snowboard pole of claim 6 wherein said ankle bracket comprises a channel that engages an upper edge of said basket.

10. The telescoping snowboard pole of claim 9 wherein displacement of said basket with respect to said ankle bracket releases said upper edge from said channel.

* * * * *